US009004713B2

(12) United States Patent
Mandy et al.

(10) Patent No.: US 9,004,713 B2
(45) Date of Patent: Apr. 14, 2015

(54) ILLUMINATION ASSEMBLY

(75) Inventors: Terry Roy Mandy, Paradise Valley, AZ (US); Dalton John Mandy, Scottsdale, AZ (US); Brandon Roy Mandy, Scottsdale, AZ (US)

(73) Assignee: Man-D-Tec, Inc., Scottsdale, AZ (US)

( * ) Notice: Subject to any disclaimer, the term of this patent is extended or adjusted under 35 U.S.C. 154(b) by 521 days.

(21) Appl. No.: 13/344,629

(22) Filed: Jan. 6, 2012

(65) Prior Publication Data

US 2012/0106138 A1 May 3, 2012

Related U.S. Application Data

(63) Continuation-in-part of application No. 12/207,795, filed on Sep. 10, 2008, now Pat. No. 8,092,035.

(51) Int. Cl.

| | |
|---|---|
| ***F21V 15/00*** | (2006.01) |
| ***B66B 11/02*** | (2006.01) |
| ***F21S 8/02*** | (2006.01) |
| ***F21V 9/14*** | (2006.01) |
| ***F21V 14/08*** | (2006.01) |
| ***F21V 19/00*** | (2006.01) |
| ***F21V 19/04*** | (2006.01) |
| ***F21V 21/04*** | (2006.01) |
| *F21V 29/00* | (2006.01) |
| *F21Y 101/02* | (2006.01) |

(52) U.S. Cl.

CPC ..... *B66B 11/0233* (2013.01); *F21S 8/02* (2013.01); *F21S 8/026* (2013.01); *F21V 9/14* (2013.01); *F21V 14/08* (2013.01); *F21V 19/001* (2013.01); *F21V 19/04* (2013.01); *F21V 21/04* (2013.01); *F21V 29/004* (2013.01); *F21Y 2101/02* (2013.01)

(58) Field of Classification Search

USPC ..... 362/147, 296.05, 296.07, 296.08, 302, 362/303, 304, 305, 364, 365, 311.01, 362/311.02, 311.04

See application file for complete search history.

(56) References Cited

U.S. PATENT DOCUMENTS

| | | | |
|---|---|---|---|
| 1,767,988 | A | 6/1930 | Knapp |
| 2,835,791 | A | 5/1958 | Horwitz |
| 3,189,788 | A | 6/1965 | Cady |
| 3,336,473 | A | 8/1967 | Buzan |
| 3,760,179 | A | 9/1973 | Addington, Jr. |
| 3,808,499 | A | 4/1974 | Edwards |
| 4,032,828 | A | 6/1977 | Strobl et al. |
| 4,071,749 | A | 1/1978 | Balogh |
| 4,156,891 | A | 5/1979 | Roche |
| 4,218,725 | A | 8/1980 | Heffner et al. |
| 4,223,232 | A | 9/1980 | Bulat |
| 4,234,907 | A | 11/1980 | Daniel |
| 4,241,871 | A | 12/1980 | Newell, III et al. |
| 4,271,621 | A | 6/1981 | Garcia et al. |
| 4,441,143 | A | 4/1984 | Richardson, Jr. |
| 4,504,894 | A | 3/1985 | Reibling |
| 4,520,436 | A | 5/1985 | McNair et al. |
| 4,587,597 | A | 5/1986 | Meyers |
| 4,682,078 | A | 7/1987 | Pascilade |

(Continued)

*Primary Examiner* — Y My Quach Lee

(74) *Attorney, Agent, or Firm* — Reising Ethington P.C.

(57) ABSTRACT

An interior illumination assembly comprising a lamp housing mountable on an interior panel and a lamp removably supportable within the lamp housing. The lamp includes an LED module carrying an LED and removably receivable by the lamp housing into an installed position in the lamp housing. A lens is disposed across the module opening and a reflector carried by the LED module reflects light from the LED through the lens into the compartment.

27 Claims, 9 Drawing Sheets

(56) References Cited

U.S. PATENT DOCUMENTS

| | | | | |
|---|---|---|---|---|
| 4,727,291 | A | 2/1988 | Bavaro | |
| 4,749,908 | A | 6/1988 | Stifter | |
| 4,751,398 | A | 6/1988 | Ertz, III | |
| 4,802,065 | A | 1/1989 | Minter et al. | |
| 4,875,553 | A | 10/1989 | Smith et al. | |
| 4,885,663 | A | 12/1989 | Parker | |
| 4,905,579 | A | 3/1990 | Dame | |
| 4,907,132 | A | 3/1990 | Parker | |
| 4,977,818 | A | 12/1990 | Taylor et al. | |
| 5,003,432 | A | 3/1991 | Mandy | |
| 5,005,108 | A | 4/1991 | Pristash et al. | |
| 5,021,928 | A | 6/1991 | Daniel | |
| 5,025,349 | A | 6/1991 | Gow | |
| 5,123,875 | A | 6/1992 | Eubank et al. | |
| 5,145,247 | A | 9/1992 | Mandy | |
| 5,161,879 | A | 11/1992 | McDermott | |
| 5,568,964 | A | 10/1996 | Parker et al. | |
| 5,613,751 | A | 3/1997 | Parker et al. | |
| 5,618,096 | A | 4/1997 | Parker et al. | |
| 5,850,126 | A | 12/1998 | Kanbar | |
| 5,876,107 | A | 3/1999 | Parker et al. | |
| 5,894,686 | A | 4/1999 | Parker et al. | |
| 5,895,115 | A | 4/1999 | Parker et al. | |
| 5,921,652 | A | 7/1999 | Parker et al. | |
| 6,030,089 | A | 2/2000 | Parker et al. | |
| 6,079,838 | A | 6/2000 | Parker et al. | |
| 6,158,867 | A | 12/2000 | Parker et al. | |
| 6,185,356 | B1 | 2/2001 | Parker et al. | |
| 6,712,481 | B2 | 3/2004 | Ezell et al. | |
| 6,752,505 | B2 | 6/2004 | Parker et al. | |
| 6,827,456 | B2 | 12/2004 | Parker et al. | |
| 6,872,220 | B2 | 3/2005 | Williams et al. | |
| 6,874,925 | B2 | 4/2005 | Page et al. | |
| 7,077,544 | B2 | 7/2006 | Parker | |
| 7,261,453 | B2 | 8/2007 | Morejon et al. | |
| 7,722,216 | B2 * | 5/2010 | Amor et al. | 362/364 |
| 2004/0125246 | A1 | 7/2004 | Okamori et al. | |
| 2005/0036321 | A1 * | 2/2005 | Ward | 362/365 |
| 2005/0190345 | A1 | 9/2005 | Dubin et al. | |
| 2006/0038192 | A1 | 2/2006 | Williams | |
| 2007/0242461 | A1 | 10/2007 | Reisenauer et al. | |
| 2007/0247850 | A1 * | 10/2007 | Hawkins et al. | 362/267 |
| 2010/0002451 | A1 * | 1/2010 | Reynolds | 362/364 |
| 2011/0170298 | A1 * | 7/2011 | Anaokar et al. | 362/147 |
| 2013/0010476 | A1 * | 1/2013 | Pickard et al. | 362/311.01 |

* cited by examiner

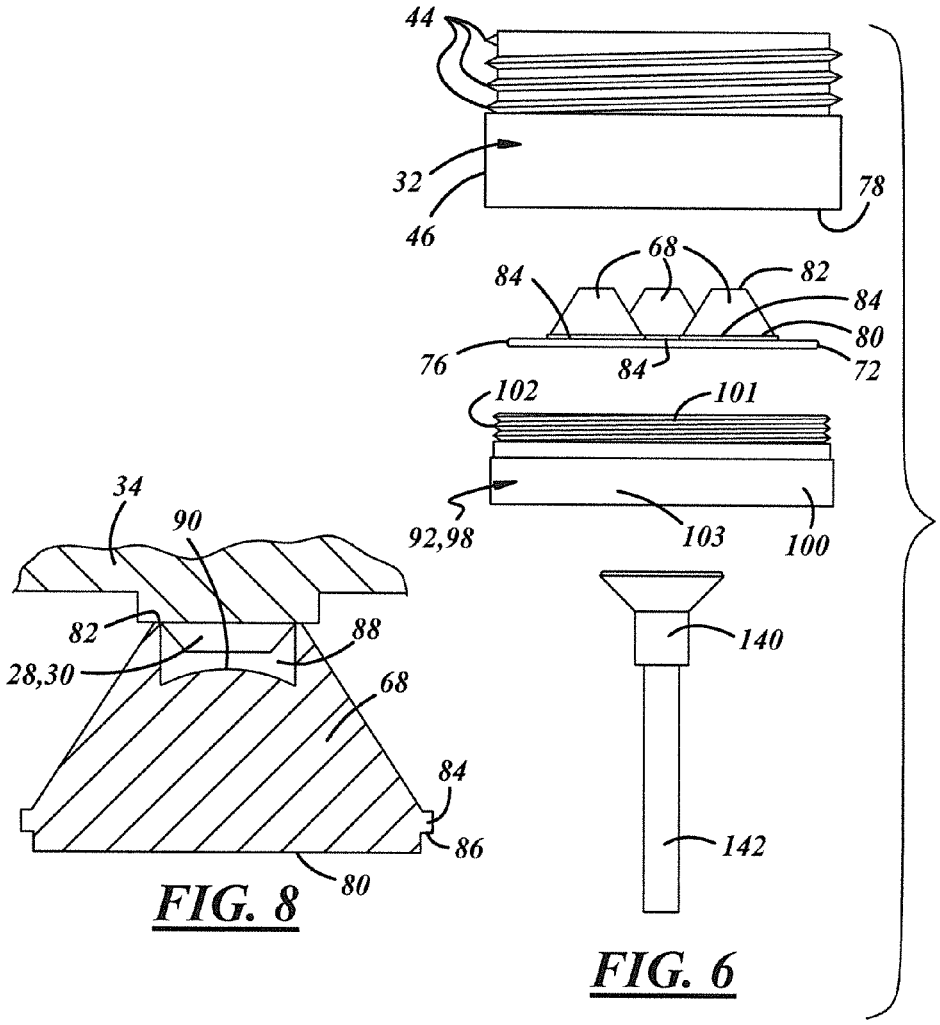
FIG. 8
FIG. 6
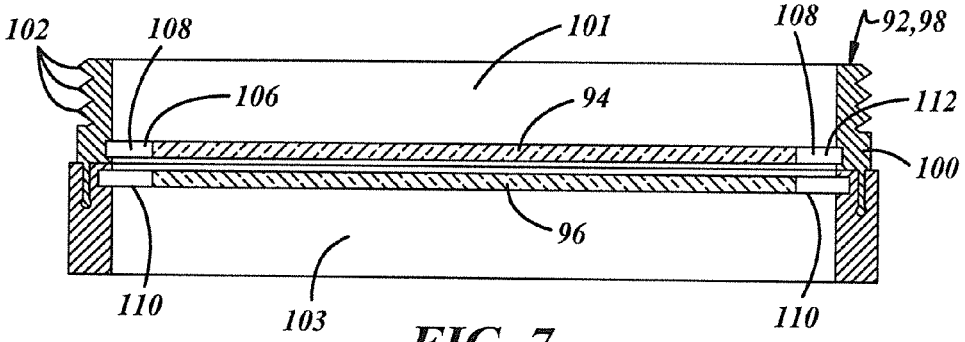
FIG. 7

| JUMPER 1 | JUMPER 2 | OUTPUT |
|---|---|---|
| OPEN | OPEN | 350mA |
| OPEN | SHORTED | 700mA |
| SHORTED | SHORTED | 1050mA |

ILLUMINATION ASSEMBLY

CROSS-REFERENCES TO RELATED APPLICATIONS

This application is a continuation-in-part of Ser. No. 12/207,795, filed Sep. 10, 2008.

STATEMENT REGARDING FEDERALLY SPONSORED RESEARCH OR DEVELOPMENT

Not Applicable

BACKGROUND

1. Field

Illuminating the interior of a compartment such as an elevator passenger compartment.

2. Description of the Related Art Including Information Disclosed Under 37 CFR 1.97 and 1.98

It is known for screw-in type replaceable light emitting diode (LED) lamps to be used in lamp housings such as track lighting housings. However, existing LED lamp designs are generally adapted to retrofit such LED lamps into lamp housings designed to accept standard screw-in type incandescent lamps.

BRIEF SUMMARY OF THE DISCLOSURE

An assembly for illuminating the interior of a compartment and comprising a lamp housing having an opening at one end and configured to be mounted on an interior panel in a position to direct light from the housing opening into the compartment through a hole in the panel. A lamp is removably supportable within the lamp housing in a position to emit light from the housing through the housing opening when the lamp is energized. The lamp includes an LED module having a module opening at one end and carrying a light-emitting diode (LED). The LED module is removably receivable by the lamp housing into an installed position in which light emitted by the LED is directed through the module opening and the housing opening. A lens is disposed across the module opening and a reflector is carried by the LED module and configured and disposed in a position to reflect light from the LED such that the light passes through the housing and module openings and the lens into the compartment when the LED module is in its installed position in the lamp housing.

BRIEF DESCRIPTION OF THE SEVERAL VIEWS OF THE DRAWINGS

These and other features and advantages will become apparent to those skilled in the art in connection with the following detailed description and drawings of one or more embodiments of the invention, in which:

FIG. 6 is an exploded view of the LED module and filter module of interior illumination assembly of FIG. 2 and also showing a suction cup positioned to engage and rotate a lower filter of the filter assembly;

FIG. 7 is a front cross-sectional view of the filter module of the interior illumination assembly of FIG. 2;

FIG. 8 is a cross-sectional view of an LED magnifying lens of the interior illumination assembly of FIG. 2;

DETAILED DESCRIPTION

Figure 1:
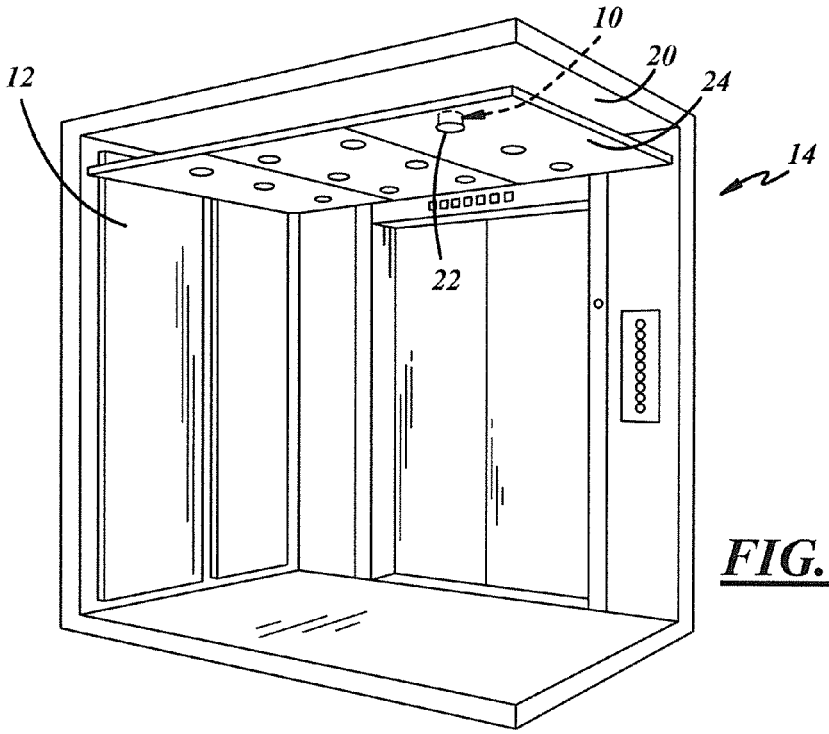
FIG. 1 is a cut-away perspective view of an elevator having installed a plurality of interior illumination assemblies.

An interior illumination assembly for illuminating the interior of a room or compartment 12 such as a passenger compartment or cab 12 of an elevator 14 is shown at 10 in FIGS. 1-12. Although the embodiment of the assembly 10 shown in FIGS. 1-14 is an elevator ceiling application in which light is directed downwardly into an elevator passenger cab 12, other embodiments of the assembly 10 may be adapted to illuminate any interior space in which light may be directed in any desired or suitable direction. Hence, where this description uses words such as "upper", "upward", "lower", and "downward"; such words are intended as convenient directional modifiers describing relative positions of various components. They are not intended to limit the assembly 10 to a vertical orientation or attitude or to downwardly-directed lighting applications.

The assembly 10 may include a generally canister-shaped lamp housing 16 that may comprise cast metal, may be configured to be mounted on a ceiling panel 24 of, for example, an elevator 14, and may have an opening 18 at a lower end of the housing 16. More specifically, the lamp housing 16 may be mounted in, for example, an elevator plenum 20 in a position to direct light downward through a hole 22 formed in a ceiling panel 24 defining the elevator plenum. The lamp housing 16 may include a retainer clamp 26 positioned to securely mount the lamp housing 16 to a ceiling panel 24. The retainer clamp 26 may be of any suitable type known in the art to include the types disclosed in U.S. Pat. No. 5,003,432 issued 26 Mar. 1991; U.S. Pat. No. 5,408,394 issued 18 Apr. 1995; U.S. Pat. No. 5,412,542 issued 2 May 1995; or U.S. Pat. No. 7,066,617 issued 27 Jun. 2006; which are all assigned to the assignee of the present invention and are incorporated herein by reference. The retainer clamp 26 locks the lamp housing 16 to a ceiling panel 24. In an elevator application this would help to prevent the assembly 10 from breaking loose and falling from a ceiling panel 24 in an annual elevator drop test or actual elevator malfunction that results in sudden deceleration.

A lamp 28 may be removably supported within the lamp housing 16 in a position to emit light from the housing 16 through the housing opening 18 into a compartment 12 when the lamp 28 is energized. The lamp 28 may comprise a light-emitting diode (LED) and, as shown in the drawings, may include three high-powered light-emitting diodes (LEDs) 30 of the type having, for example, the specifications: 1001 m, 3 watt, 2800-3050K (warm white) @3.5V In other embodiments the lamp 28 may include any suitable type and number of LEDs. The assembly 10 is configured to allow for LEDs 30 to be removed from the assembly 10 from within a compartment 12 in which the assembly 10 is installed and without having to remove the lamp housing 16. In other words, a person can gain access to and remove the LEDs 30 from the assembly 10 from a position standing in a compartment such as the passenger compartment 12 of the elevator 14. There is no need for a person to gain access to the assembly 10 from above, e.g., through an upper access panel or trap door of an elevator 14.

The LEDs 30 may be carried by a generally disk or puck-shaped LED module 32 that may be removably received by the lamp housing 16. The LED module 32 and lamp housing 16 may be sized for mounting in a low-clearance space such as an elevator plenum 20. The LED module 32 may include a thermal conductor 34 which may include a generally cylindrical die-cast metal heat sink 34 that may carry the LEDs 30. The LEDs may be carried in a triangular array on a lower axially-recessed circular upper wall 36 of a lower cylindrical recess 38 of the heat sink 34 such that the LEDs 30 can dissipate heat through thermally conductive communication with the heat sink 34 and such that light emissions from the LEDs 30 are directed downward through the housing opening 18 when the LED module 32 is received in the lamp housing 16. In other words, the lamp housing 16 removably receives the LED module 32 and supports the LED module 32 in a position to direct light emitted from the LEDs 30 downward into a compartment such as the passenger cab of the elevator 14.

Figure 2:
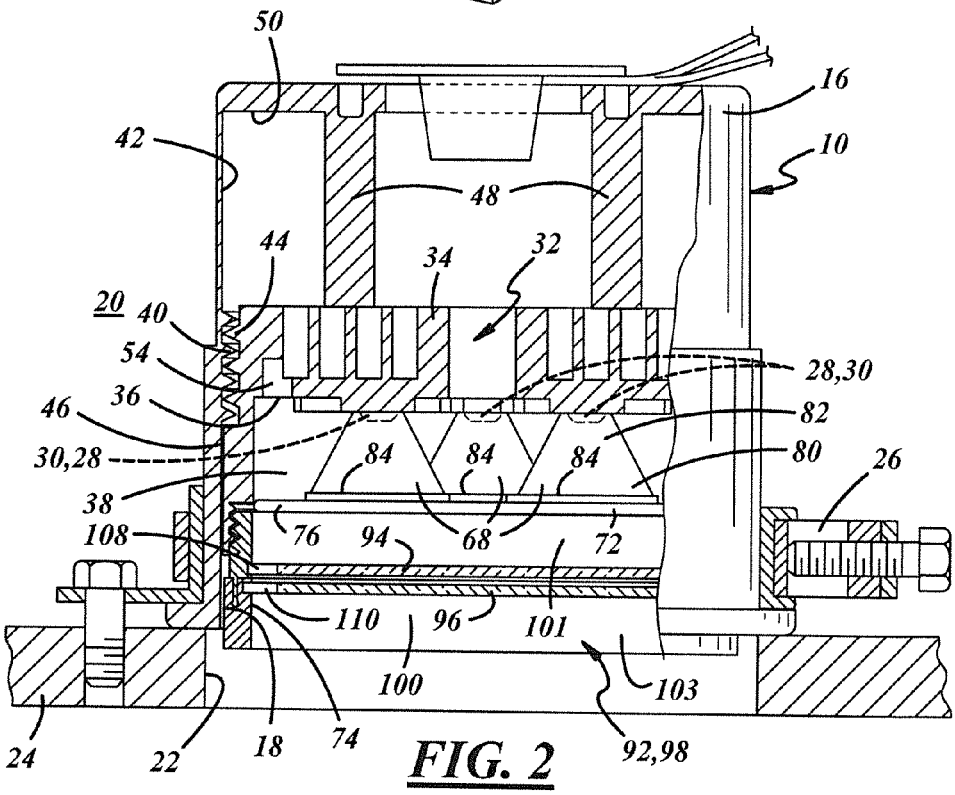
FIG. 2 is a partially cut-away front cross-sectional view of one of the interior illumination assemblies of FIG. 1.
Figure 3:
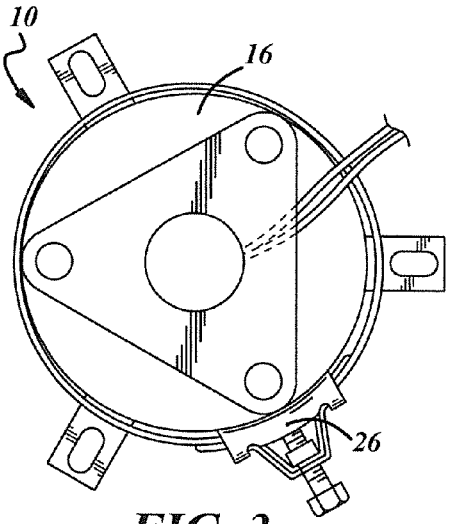
FIG. 3 is a top view of the interior illumination assembly of FIG. 2.
Figure 4:
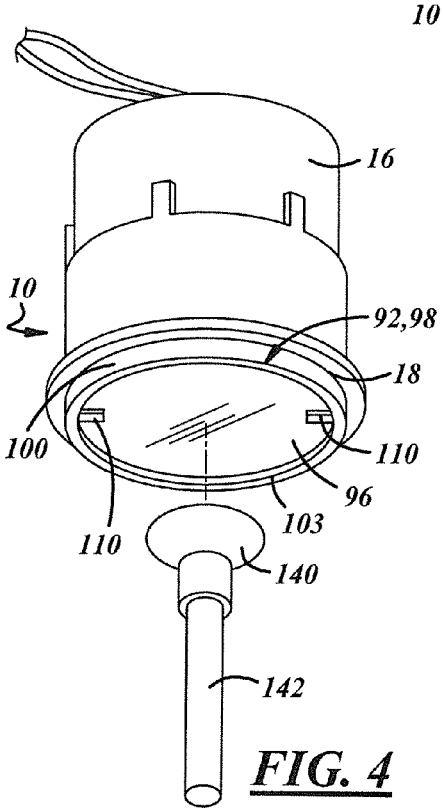
FIG. 4 is an isometric bottom-front view of the interior illumination assembly of FIG. 2 removed from an elevator ceiling panel for clarity and showing a suction cup being positioned to engage and rotate a lower polarizing filter of the assembly.
Figure 5:
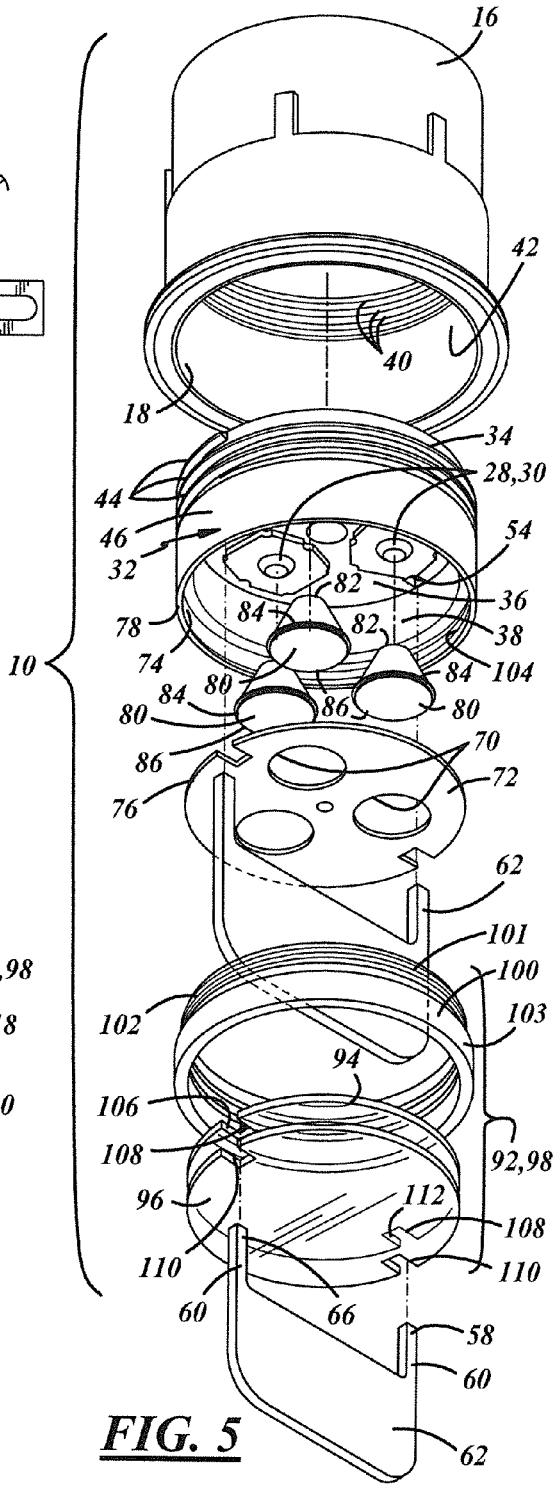
FIG. 5 is an exploded view of the interior illumination assembly of FIG. 2 also showing, in two places, an installation wrench for installing an LED module and a filter module of the assembly.
Figure 10:
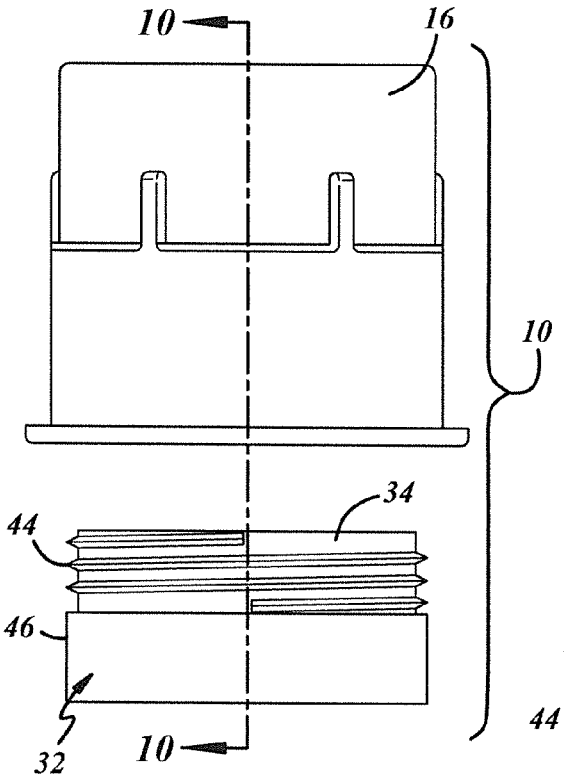
FIG. 10 is an exploded view of a lamp housing and LED module of the interior illumination assembly of FIG. 2.
Figure 11:
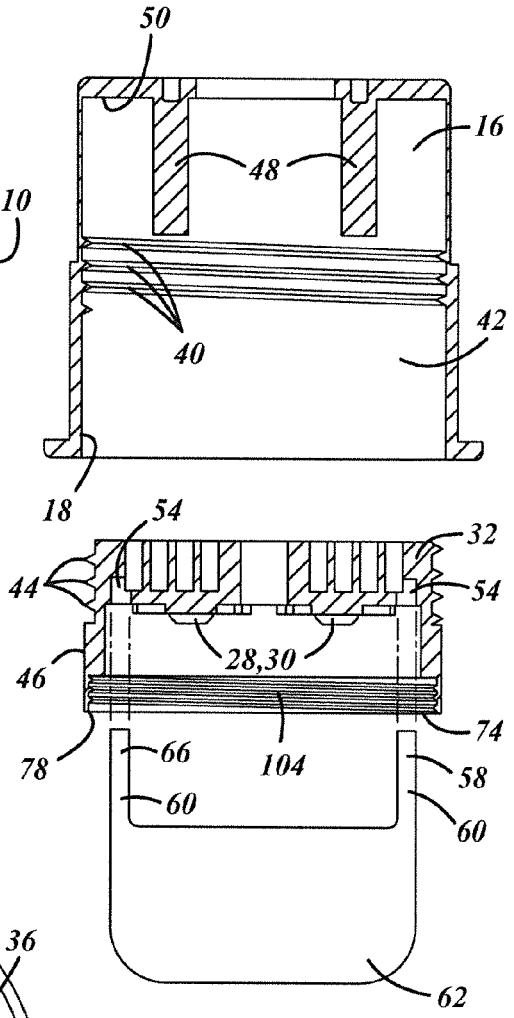
FIG. 11 is a cross-sectional exploded view of the lamp housing and LED module of the interior illumination assembly of FIG. 2 and also showing an installation wrench being positioned to engage the LED module for the purpose of installing the LED module in the lamp housing.

As best shown in FIGS. 2, 5, and 6, one or more housing detents 40 may be provided in the lamp housing 16 to receive one or more corresponding module detents 44 provided on the LED module 32. As best shown in FIG. 2 the housing and module detents 40, 44 may be arranged to engage and hold the LED module 32 and housing 16 together in respective positions providing mechanical and thermal connections between the LED module 32 and the lamp housing 16. The housing and module detents 40, 44 are further arranged and shaped to engage through simple axial insertion of the LED module 32 into the lamp housing 16 and rotation of the LED module 32 relative to the housing 16. The rotation of the LED module 32 in this operation causes the module detents 44 to engage the housing detents 40 in such a way as to resist axial separation of the LED module from the lamp housing. As best shown in FIGS. 2 and 5, the housing and module detents 40, 44 may comprise threads cast or otherwise formed into an inner cylindrical wall 42 of the lamp housing 16 and into an outer circumferential surface 46 of the module heat sink 34, respectively, such that the threads of the housing detent 40 may receive the threads of the module detent 44 in threaded engagement. The housing may include a stop that may include two cast-in standoffs or posts 48 that may extend integrally and axially downward from a circular upper wall 50 of the lamp housing 16 and engage the thermal conductor 34 of the LED module 32 to limit the threaded advance of the LED module 32 to a desired depth into the lamp housing 16 during assembly, to provide a thermal conduction path from the module heat sink 34 to the lamp housing 16, and to lock the LED module 32 against rotating or even falling out of the lamp housing 16 during, for example, sudden decelerations of the type that occur in elevator applications during an elevator drop test or an actual elevator malfunction.

Figure 9:
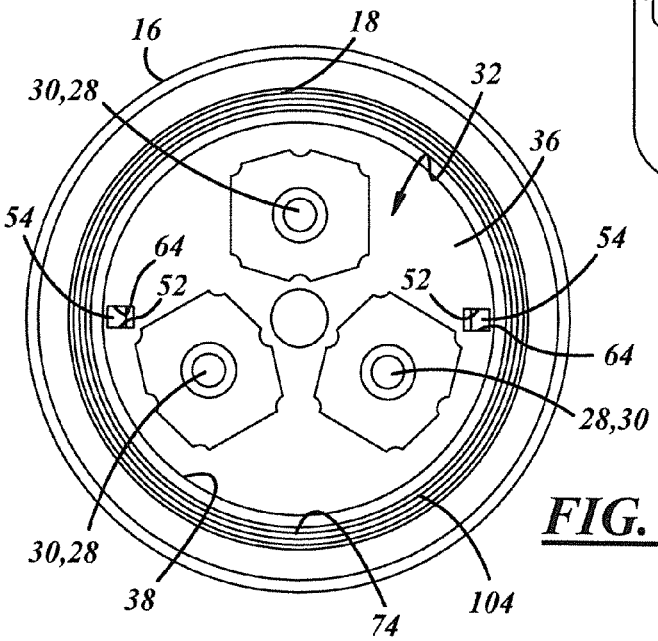
FIG. 9 is a bottom view of the lamp housing and LED module of interior illumination assembly of FIG. 2.

As is best shown in FIG. 9, the LED module 32 may include two LED module removal detent surfaces 52 disposed in two small holes or LED module engagement apertures 54 disposed in diametrically opposite positions on the circular upper wall 36 of the LED module 32 and positioned to be engaged by respective wrench first detent surfaces 58 on complementary-shaped prongs 60 of a spanner wrench 62 shaped and positioned to allow a user to remove the LED module 32 from the lamp housing 16 by using the wrench 62 to engage and apply counterclockwise torque to and rotate the LED module 32 relative to the lamp housing 16.

The LED module 32 may also include two LED module installation detent surfaces 64 disposed in the same small apertures 54 where, as is again best shown in FIG. 9, the LED module removal detent surfaces 52 are disposed. The LED module installation detent surfaces 64 may be positioned to be engaged by respective wrench second detent surfaces 66 that may be disposed on the same complementary-shaped wrench prongs 60 as the wrench first detent surfaces 58 so that an installer can install the LED module 32 by using the wrench 62 to engage and apply clockwise torque to and rotate the LED module 32 relative to the lamp housing 16. This arrangement allows a user possessing such a wrench 62 to remove the LED module 32 from the lamp housing 16 and to replace the LED module 32 in the lamp housing 16, and to accomplish either procedure from a position within the compartment 12.

The LED module 32 may also carry three magnifying lenses 68 supported in a triangular array and in axial alignment with the respective LEDs 30 and disposed between the three respective LEDs 30 and the compartment 12. The three magnifying lenses 68 may be so positioned to maximize the amount of light directed from the three LEDs 30 into the compartment 12. The lenses 68 may be carried in respective circular apertures 70 formed in a circular disk-shaped aluminum LED lens plate 72 that may be supported across a lower opening 74 of the lower cylindrical recess 38 of the heat sink 34. In other words, an outer circumferential rim 76 of the LED lens plate 72 may be secured to a circular heat sink rim 78 that defines the lower opening 74 of the lower cylindrical recess 38 of the heat sink 34.

Each magnifying lens 68 may have the general shape of a frusto-conical prism having a circular lower surface 80 that may be disposed axially opposite a circular upper apex 82.

Each magnifying lens 68 may also include an annular rim 84 that extends radially and integrally outward from around the lens 68 adjacent the lower surface 80 and includes a circumferential land 86 shaped and sized to engage a portion of the LED lens plate 72 surrounding one of the circular apertures 70 formed in the LED lens plate 72.

As is best shown in FIG. 8, each magnifying lens 68 may include a generally cylindrical LED receiver recess 88 at its apex. The LED receiver recess 88 of each magnifying lens 68 may be shaped and positioned to receive an LED 30 in a desired position relative to the lens 68. The three magnifying lenses 68 may be carried by the LED lens plate 72 in respective positions such that their LED receiver recesses 88 are positioned to receive the respective LEDs 30 when the LED lens plate 72 is installed on the heat sink 34, and such that light from the LEDs 30 is emitted downward through the lenses while heat conducted from the LEDs 30 is dispersed by the heat sink 34. The LED receiver recesses 88 of the magnifying lenses 68 may each include a convex base surface 90 shaped to further disburse and magnify the light emitted by the LEDs 30 through the magnifying lenses 68.

The assembly 10 may further include an LED dimmer 92 that is accessible from within the compartment 12 to adjust the amount of light emitted by the LEDs 30 into a compartment 12, e.g., the passenger cab of an elevator 14, in which the assembly 10 is installed. The LED dimmer 92 may comprise two polarizing filters 94, 96 carried by the lamp housing 16 below the lamp 28 and coaxially supported for relative rotation between conditions of parallel polarization (high projected light intensity) and cross-polarization (low projected light intensity). An upper filter 94 or the two polarizing filters may be secured against rotation relative to the lamp housing 16 and a lower filter 96 of the two filters may be free to rotate relative to the lamp housing 16. The filters 94, 96 may be oriented across a paths of light emitted from the LEDs 30 such that, when the LEDs 30 are energized, their emitted light passes through both filters 94, 96 allowing the intensity of emitted light to be controlled by relative rotation of the polarizing filters 94, 96.

The assembly 10 may include a polarizing filter module 98 which may comprise a two-part retainer ring 100 having an upper part 101 that supports the upper filter 94 of the polarizing filters 94, 96 against rotation relative to the retainer ring 100, and a lower part 103 that supports the lower filter 96 of the polarizing filters for rotation relative to the retainer ring 100 and the upper filter 94. As best shown in FIG. 7, the upper part 101 may be mechanically interlocked with the lower part 103 in such a way as to hold the two parts together axially while allowing the lower part 103 to rotate relative to the upper part 101. The polarizing filter module 98 may be removably installable in the lamp housing 16 such that the upper part 101 is supportable against rotation relative to the lamp housing 16 while the lower part 103 is free to rotate. More specifically, the upper part 101 of the retainer ring 100 may include exterior circumferential threads 102 engageable with corresponding interior circumferential threads 104 formed in the lower cylindrical recess 38 of the heat sink 34 which, as described above, is removably installable in the lamp housing 16 and supportable against rotation relative to the lamp housing 16. When the polarizing filter module 98 is installed in the cylindrical recess 38 of the heat sink 34 the retainer ring 100 is threadedly engaged with the cylindrical recess 38 with sufficient rotational force to insure that the lower filter 96 can be rotated relative to the upper filter 94 without rotating the retainer ring 100 relative to the heat sink 34 and lamp housing 16. This arrangement allows the polarizing filter module 98 to be installed in the lower cylindrical recess 38 of the heat sink 34 while the heat sink 34 is installed in the lamp housing 16, in such a way as to allow an operator to rotate the lower filter 96 relative to the upper filter 94 from a position within the compartment 12, e.g., the passenger cab of an elevator 14, in which the assembly 10 is installed, without also rotating the upper filter 94 relative to the lamp housing 16.

The polarizing filter module 98 may include two filter module removal detent surfaces 106 disposed in respective filter module engagement apertures 108 positioned to be engaged by the respective wrench first detent surfaces 58 disposed on respective wrench prongs 60 of the spanner wrench 62, which are shaped to allow an installer to apply counter-clockwise torque to and rotate the polarizing filter module 98 counter-clockwise relative to the lamp housing 16. The lower filter 96 may include lower lens apertures 110 axially alignable with the respective filter module engagement apertures 108 in which are disposed the filter module removal detent surfaces 106 in the upper filter 94, and which are shaped to allow prongs 60 of a spanner wrench 62 to extend through the lower lens apertures 110 of the lower filter 96 and engage the filter module removal detent surfaces 106 of the upper filter 94. This allows an installer to apply counter-clockwise torque to the filter module 98 to unthread and remove the filter module 98 from the lamp housing 16.

The polarizing filter module 98 may also include two filter module installation detent surfaces 112 disposed in the respective filter module engagement apertures 108. The filter module installation detent surfaces 112 may be positioned to be engaged by respective wrench second detent surfaces 66 disposed on the respective wrench prongs 60 of the spanner wrench 62 to allow an installer to apply clockwise torque to the filter module 98 to install the filter module 98 by rotating it clockwise relative to the lamp housing 16 and threading the module into the lamp housing 16. The lower lens apertures 110 may be axially aligned with the respective filter module engagement apertures 108 in which are disposed the filter module installation detent surfaces 112 in the upper filter 94 and may be shaped to allow the prongs 60 of the spanner wrench 62 to extend through the lower lens apertures 110 of the lower filter 96 and engage the installation detent surfaces of the upper filter 94 so that an installer can apply clockwise torque to the filter module 98 to install the filter module in the lamp housing 16. The upper lens apertures and lower lens apertures 110 may be spaced from each other and shaped generally the same as the LED module engagement apertures 54 so that the same wrench 62 may be shaped to both install and uninstall both the filter module 98 and the LED module 32.

Figure 12:
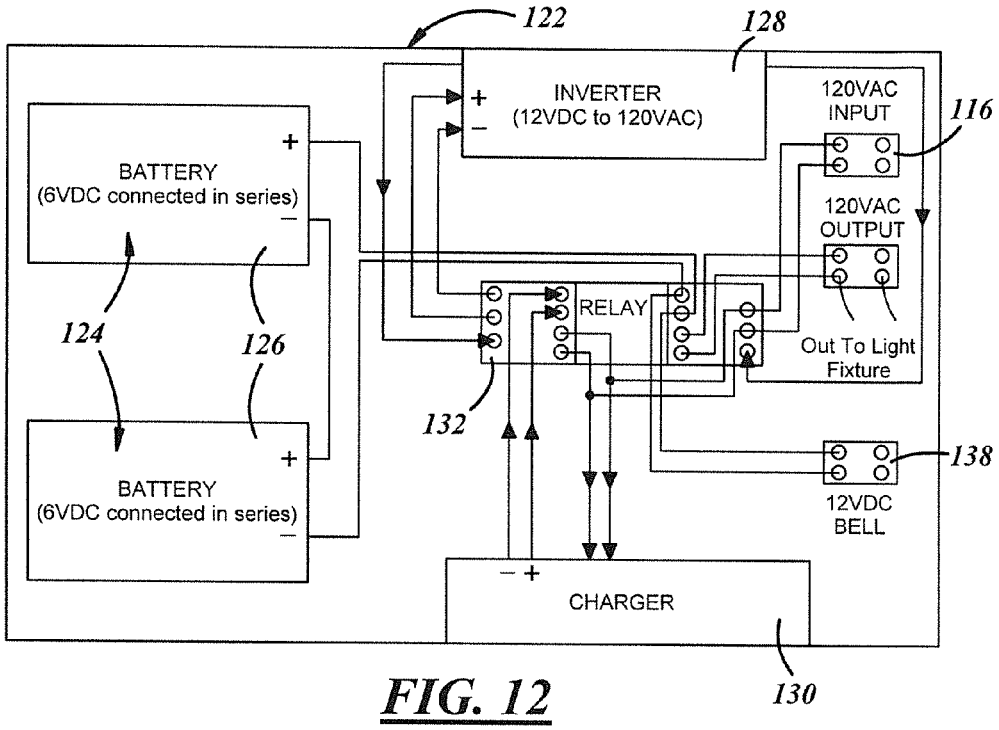
FIG. 12 is a schematic block diagram of an emergency power supply for the interior illumination assembly of FIG. 2.
Figure 13:
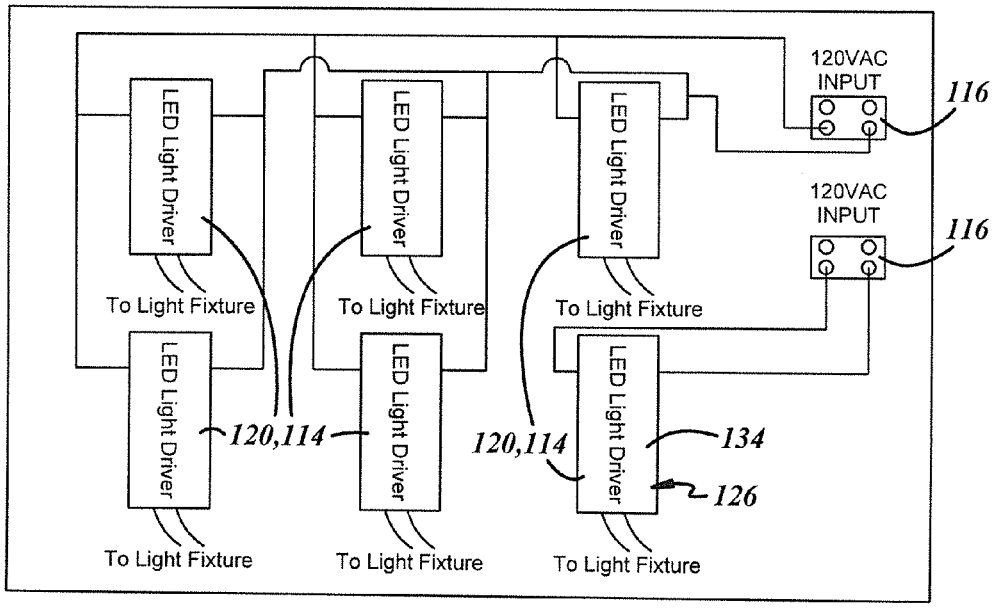
FIG. 13 is a schematic block diagram of power supplies for six of the interior illumination assemblies of FIG. 2.
Figure 14:
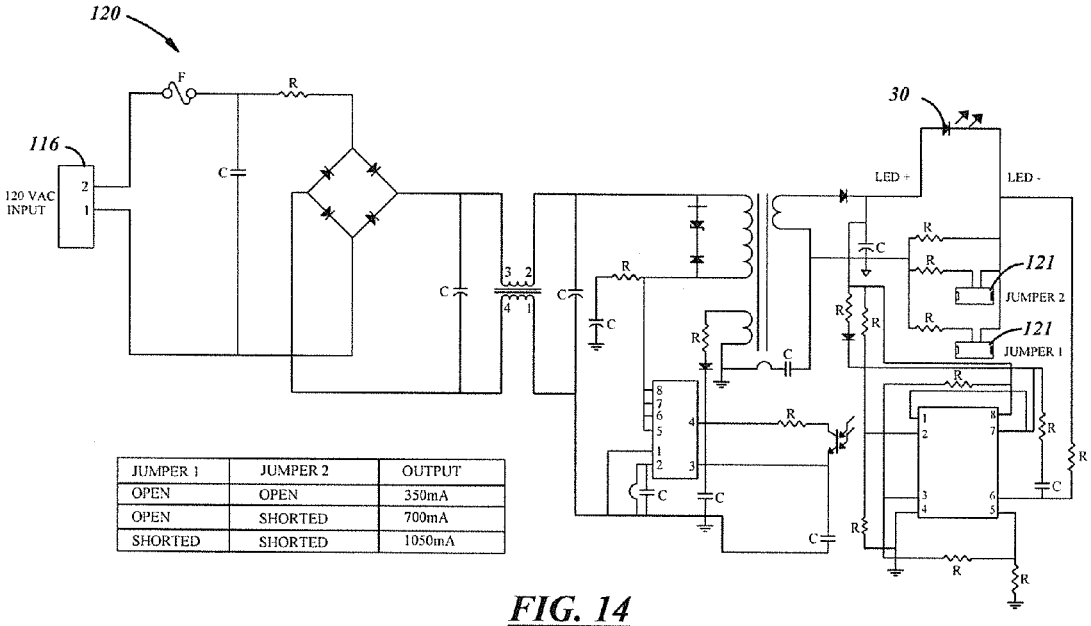
FIG. 14 is a schematic representation of an exemplary LED driver.

A single application may include a plurality of interior illumination assemblies 10, each including an LED dimmer 92. As shown in FIG. 12, each assembly 10 may each include an electrical power supply 114 that's electrically connected to the LEDs 30 of each assembly 10 and that conditions electrical power provided by an external electrical power source 116 such as an elevator power distribution system, to illuminate the LEDs 30 of each interior illumination assembly 10. Each power supply 114 may include an electronic driver, such as the one shown schematically at 120 in FIG. 14, that's connected between the external electrical power source 116 and one of the interior illumination assemblies to condition power supplied to the LEDs 30 of the interior illumination assembly. The external electrical power source 116 may provide 120 VAC electrical current, and each power supply 114 may include a 120 VAC input, 3-21 VDC output, 700 mA constant-current driver 120 that may be connected in parallel with the other such drivers 120 between the external electrical power source 116 and the LEDs 30 of each assembly 10 of the plurality of interior illumination assemblies 10, respectively, to convert the 120 VAC provided by the external electrical power source 116 to constant DC current suitable to energize the LEDs 30 of the interior illumination assemblies 10. Each driver 120 may also include two or more current jumpers 121 selectably connectable between a source of electrical power 116 and the LEDs 30 to regulate light output from the LEDs 30 and serve as either an alternative or supplemental LED dimmer 92. As shown in the FIG. 14 schematic representation of an exemplary LED driver 120, an output of 350 mA to the LEDs 30 may be realized by opening both current jumpers 121, an output of 700 mA may be realized by opening one and shorting the other current jumper 121, and an output of 1050 mA may be realized by shorting both current jumpers 121.

Where, for example, interior illumination assemblies 10 are installed in an elevator 14, the illumination assemblies 10 may also include an emergency illumination system 122. An emergency light power supply 124 for the emergency illumination system 122 may include a 12 VDC battery power source comprising two 6 VDC batteries 126 connected in series. The 12 VDC battery power source 126 may be connected to and energize an inverter 128 that is, in turn, connected to and provides power to the LEDs 30 in the event of a failure of the main power supply 114, to power at least two of the three LEDs 30 in one interior illumination assembly 10 for at least 4 hours in the event of a main electrical power supply 114 failure. In other words, one of the drivers powering one of the interior illumination assemblies 10, instead of being connected directly to the main external electrical power source 116, is normally connected to the main external electrical power source 116 through the emergency illumination system 122. Any of the interior illumination assemblies 10 may be powered through the emergency illumination system 122 in this way or may, alternatively, be connected directly to the external electrical power source 116 by, for example, jumper wires. The emergency illumination system 122 may also include a charger 130 connectable between the external electrical power source 116 and the batteries 126 to charge the batteries when external electrical power is available. A relay 132 is connected between the external electrical power source 116 and the charger 130, between the external electrical power source 116 and each of the drivers 120 connected to the interior illumination assemblies 10, between the charger 130 and the batteries 126, and between the inverter 128 and the driver 134 that's connected to the interior illumination assembly that's to be powered by the emergency illumination system 122 in the event of an external power source failure. When the external electrical power source 116 is applying 120 VAC to the relay 132, the relay 132 closes a circuit that allows electrical current to flow from the external electrical power source 116 to the drivers 120, and closes a circuit that allows electrical current to flow from the charger 130 to the batteries 126, but does not close an electrical circuit that would allow electrical power to be applied to the inverter 128. When the external electrical power source 116 fails, and is not applying 120 VAC to the relay 132, the relay is energized by 12 VDC applied by the batteries 126, opens the circuit that would otherwise allow electrical current to flow from the external electrical power source to the drivers 120, closes a circuit that allows 12 VDC electrical current to flow from the batteries 126 to the inverter 128 and 120 VAC to flow from the inverter 128 to the driver 134 that's connected to the interior illumination assembly intended to be powered by the emergency illumination system 122, and closes a circuit that allows 12 VDC to flow from the batteries 126 to an electrically-driven emergency bell 138.

In practice, emitted light levels may be equalized between interior illumination assemblies that use LEDs 30 to produce light in a compartment 12 such as an elevator passenger cab, by first providing the compartment 12 with a plurality of the interior illumination assemblies, each of which may comprise an LED dimmer 92 configured to be accessible from within the compartment 12 to adjust the amount of light emitted by the assembly 10 into a compartment 12 in which the assembly 10 is installed. A person then enters the compartment 12 and reaches up to gain access to the LED dimmers of the assemblies from within the compartment 12. The person may then adjust the light emission levels of the interior illumination assemblies by adjusting their respective LED dimmers, one at a time, to generally match that of a selected one of the interior illumination assemblies that is producing a desired light level. Where the dimmer 92 includes relatively rotatable polarizing filters 94, 96 as described above, the person may accomplish this by rotating one of the polarizing filters 94, 96 of relatively brighter interior illumination assemblies in a direction diminishing light transmission through the filters, and/or rotating one of the polarizing filters 94, 96 of a relatively darker interior illumination assembly 10 in a direction increasing light transmission through the filters.

Where the upper filter 94 of the relatively rotatable filters is fixed relative to the lamp housing 16, the LED dimmer 92 may be adjusted by rotating the lower filter 96 of the two polarizing filters 94, 96 relative to the upper filter 94. To gain access to the lower filter 96 of the two polarizing filters 94, 96 of the LED dimmer 92 an operator may apply a suction cup 140 to the lower filter 96 such that a longitudinal axis of the suction cup 140 is generally aligned with a rotational axis of the lower filter 96, and rotate the lower filter by rotating the suction cup. The suction cup 140 may be supported on a stick 142 which may then be used to extend the reach of the operator. The suction cup 140 may be rotated by rotating the stick 142 supporting the cup.

LED lamps of an interior illumination assembly 10 constructed as described above are harder to steal than the lamps of current designs because a special tool must be used to remove an LED module 32 of such an assembly 10. In addition, the superior longevity of LED lamps dramatically reduces the frequency of lamp replacement over incandescent lamp use—especially in light of the fact that elevator lights generally burn continuously. Also, since LED lamps are less likely to fail, in elevator applications especially, passenger safety is enhanced. The magnifying lenses 68 of an interior illumination assembly 10 constructed according to the invention provide more light with less energy and fulfill elevator code requirements for protecting passengers from bulb breakage. A single interior illumination assembly 10 constructed according to the invention and including at least two LEDs has the additional advantage of meeting elevator code requirements for emergency lighting. This is because the emergency light power supply 124 that may be included in an assembly allows the assembly to surpass the elevator code requirement (set forth in ASME A17.1-2004 section 2.14.7.1.3) to power at least two bulbs of equal wattage for at least 4 hours. Further regarding the emergency illumination system 122, the use of LEDs allows for the use of an emergency power supply of reduced size and weight, which are important factor in elevators due to the limited size of elevator plenums and the limited power output of elevator motors/hydraulic pumps. The use of LEDs also allows for reduced interior illumination assembly size and weight due to the relatively lower power demand of LEDs and consequent reduction in size and weight of batteries 126 required for emergency operation.

An alternative embodiment of an interior illumination assembly is generally shown at 200 in FIGS. 15-21. The assembly 200 may comprise a lamp housing 202 having an opening 204 at one end, which may be mounted on an interior ceiling panel in a position to direct light from the housing opening 204 downward through a hole in the ceiling panel as described above with regard to the lamp housing 16 of the embodiment of FIGS. 1-14. As with the embodiment of FIGS. 1-14, the lamp housing 202 of this alternative embodiment may be mounted in any other suitable interior panel of a compartment, such as a wall or floor panel. In the following description, therefore, the words up and down, upward and downward, are used to more clearly describe relative positioning of components and are not intended to limit the invention or the description to being positioned to shine downward from a ceiling panel of a compartment.

A lamp generally indicated at 210 in FIGS. 15-17, 19 and 21, may be removably supportable within the lamp housing 202 in a position to emit light from the housing 202 through the housing opening 204 when the lamp 210 is energized. The lamp 210 may include an LED module 212, which may include a cylindrical wall 214 having a lower rim 216 defining a module opening 218 at a lower end. A light-emitting diode (LED) 222 may be attached by screws 274 or mounted in any other suitable means to an upper end wall 220 of the LED module 212, which may be disposed axially opposite the module opening 218. The upper end wall 220 may also be integrally formed with the cylindrical wall 214 of the LED module 212 across an upper module rim 224 of the cylindrical wall 214 as a single unitary piece. The LED module 212 may be removably receivable by the lamp housing 202 into an installed position in which light emitted by the LED 222 is directed through the module opening 218 and the housing opening 204.

The LED 222 may be of any suitable type to include one configured to emit a light beam having a 105 degree beam angle and comprising an array of six 6 "miniature" LEDs supported on a chip. In other embodiments the LED 22 may include more or less than 6 miniature LEDs and may be configured to emit a light beam or beams having a beam angle less than or greater than 105 degrees.

Figure 15:
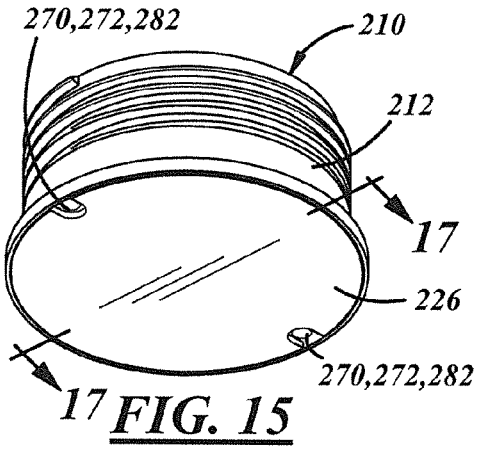
FIG. 15 is a perspective view of an alternative embodiment of an LED module carrying a single LED, a reflector, and an alternative lens.
Figure 17:
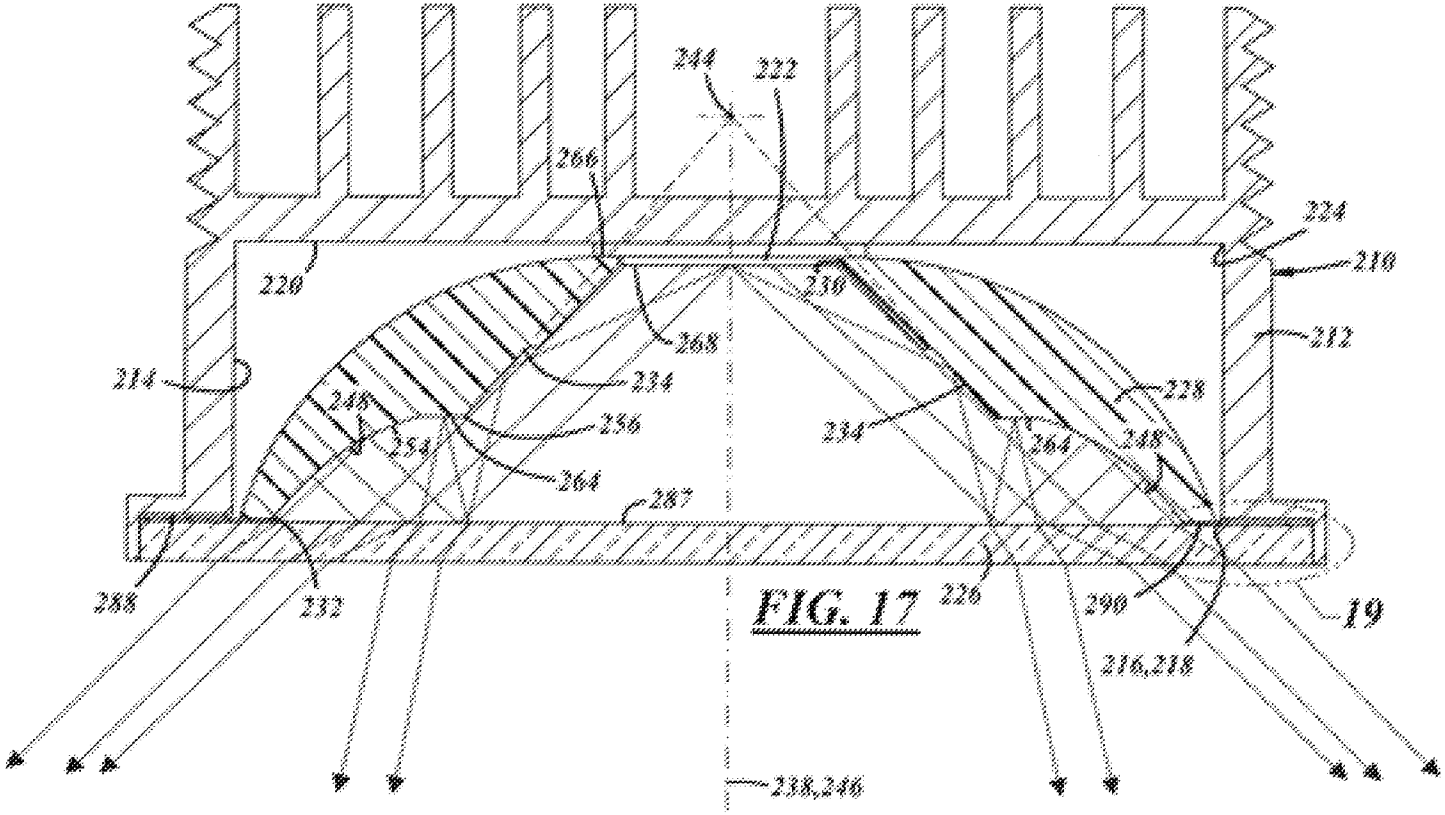
FIG. 17 is a cross-sectional view of the alternative LED module, reflector, and lens taken along line 17-17 of FIG. 15 and showing the paths of representative light rays emanating from the LED, reflecting off the lens and the reflector and refracting through the lens.

The lamp 210 may also include a lens 226 disposed across the module opening 218 as best shown in FIG. 15, and a reflector 228 carried by the LED module 212 as best shown in FIG. 17. The reflector 228 may be configured and disposed in a position to reflect through the housing and module openings 204, 218 and the lens 226 light received both directly from the LED 222 and indirectly from the LED 222 via reflection of LED-emitted light from the lens 226 as shown in FIG. 17.

The reflector 228 may comprise plastic molded into a general bowl shape having a relatively small and generally circular reflector top aperture 230 that may be disposed axially opposite a relatively large and generally circular base opening 232 as best shown in FIG. 17. The top aperture 230 may be disposed coaxially adjacent the LED 222 and may abut the LED 222. Surrounding the top aperture 230 the reflector 228 may also include a top surface 266 that engages a lower surface 268 of the LED 222. The reflector base opening 232 may be disposed coaxially adjacent the module opening 218 and may rest on the lens 226.

Figure 16:
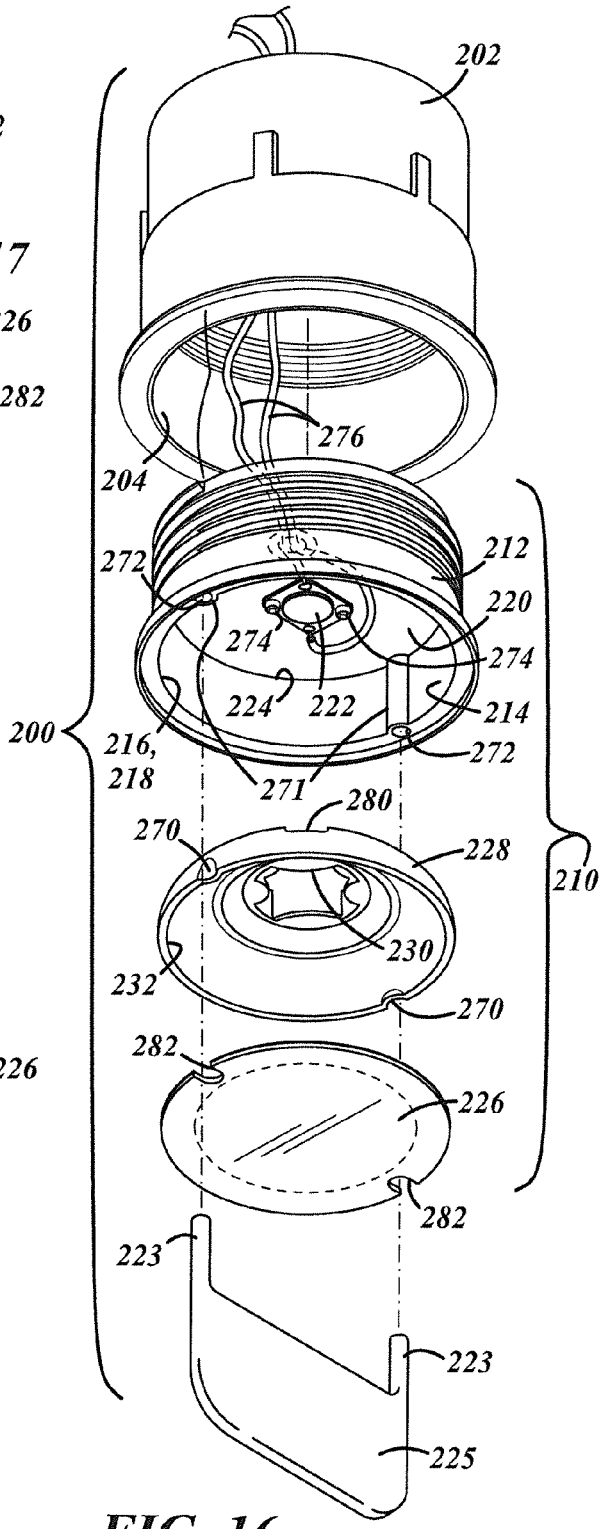
FIG. 16 is an exploded view of an interior illumination assembly including the alternative LED module, LED, reflector, and lens.

The reflector 228 may include a first generally annular (radially inner and axially upper) reflective surface 234 configured and positioned to reflect light from the LED 222 toward the lens 226 where a portion of the reflected light is reflected back toward the reflector 228 and a remaining portion of the reflected light is refracted through the lens 226 as shown in FIG. 17. As is best shown in FIGS. 16 and 17, the first annular reflective surface 234 may have a generally frustoconical shape.

As is also shown in FIG. 17, the first annular reflective surface 234 may have a linear cross-sectional profile angled outward from an imaginary apex 244 of the frusto-conically shaped surface by about 42 degrees relative to a cone axis 246 of the first annular reflective surface 234. In other embodiments, the annular reflective surface 234 may have any suitable angle, either greater or less than 42 degrees, relative to the cone axis 246 as may be required to reflect light from the LED 222 in desired directions.

The reflector 228 may also include a second generally annular, radially outer, and axially lower reflective surface 248. The second reflective surface 248 may be configured and positioned concentrically with the first reflective surface 234 as shown in FIGS. 16 and 17 in a position to reflect back toward the lens 226 light reflected off an inside facing surface 260 of the lens 226. The inner circumference 254 of the second annular reflective surface 248 may be greater than the outer circumference 256 of the first annular reflective surface 234. As shown in FIG. 17, the second annular reflective surface 248 of the reflector 228 may have a parabolic profile configured to provide a desired spread to LED light being reflected back toward the lens 226. The inner circumference 254 of the second annular reflective surface 248 may be elevated relative to an outer circumference 262 of the second annular reflective surface 248.

The reflector 228 may further include a third annular reflective surface 264 disposed between and joining the inner (first) and outer (second) annular reflective surfaces 234, 248 to reflect light in such a way as to prevent the appearance of a dark circle in the lens 226 between the inner and outer annular reflective surfaces 234, 248 of the reflector 228. The third annular reflective surface 264 may have a flat profile oriented generally normal to the beam axis 238 and configured to reflect LED light that has reflected off the inside facing surface 287 of the lens 226 as shown in FIG. 17.

The combination of light received by and refracted through the lens 226 directly from the LED and indirectly from the first, second, and third reflective surfaces 234, 248, 264 provide a combined illumination effect comprising more uniform light output across the lens 226.

Figure 20:
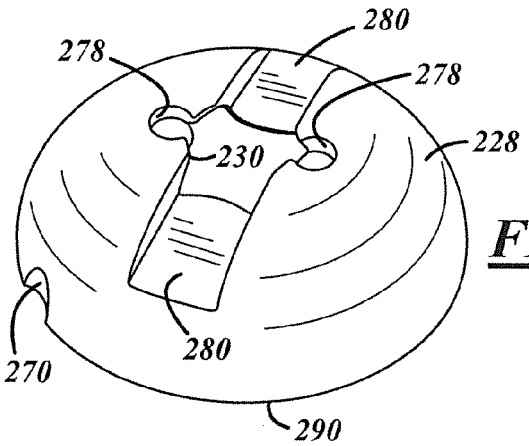
FIG. 20 is a top perspective view of the reflector of FIGS. 16, 17, and 19.
Figure 21:
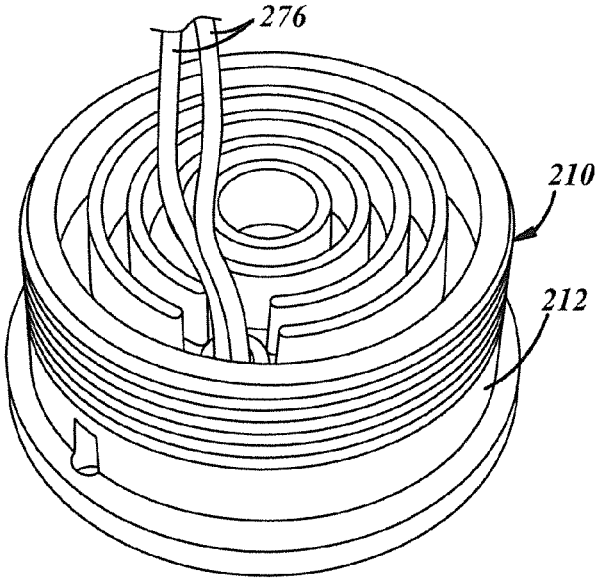
FIG. 21 is a top perspective view of the alternative LED module of FIGS. 15-17 and 19.

As best shown in FIGS. 16 and 20, the reflector 228 may include two reflector detent recesses 270 that may engage corresponding module wall detents 271 in the LED module 212. The module wall detents 271 may be engaged by the reflector detent recesses 270 such that the reflector 228 is keyed into the LED module 212 in such a way as to provide proper alignment of screw heads 274 fastening the LED to the LED module 212, and wires 276 connected between the LED and an electrical power source. The reflector 228 may include screw head recesses 278 and wire channels 280 that may be formed into the reflector 228. Keying of the reflector 228 into the LED module 212 via engagement of the reflector detent recesses 270 with the LED module wall detents 271 may align the screw had recesses 278 and wire channels 280 to receive the screw heads 274 and the wires 276. As shown in FIG. 16, the rim detents 271 of the LED module 212 may comprise two semi-cylindrical, vertically-oriented, integrally formed, interior wall surface protrusions.

Figure 18:
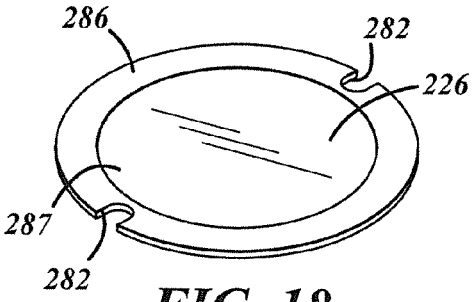
FIG. 18 is a perspective view of a top surface of the alternative lens of FIGS. 15-17.

As best shown in FIG. 18, the lens 226 may include lens apertures 282 axially alignable with prong receptacles 272 of the LED module 212 and configured to allow prongs 223 of a spanner wrench 225 to extend through the lens apertures 282 and engage and be received into prong receptacles 272 of the module 212.

Figure 19:
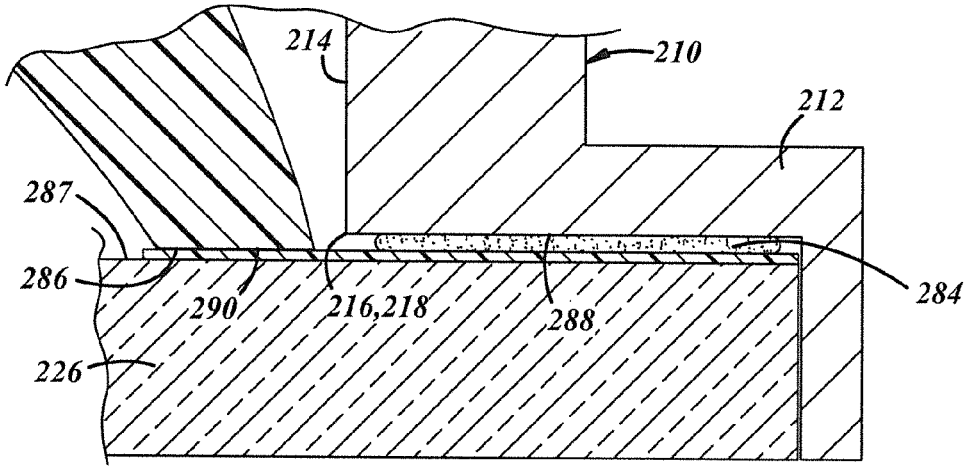
FIG. 19 is a magnified view of the alternative LED module, reflector, and lens shown in region 19 of FIG. 17.

As best shown in FIG. 19, the lens 226 may be fixed to the LED module 212 by an adhesive layer 284, of material such as a high temperature silicone. The adhesive layer 284 may be disposed between the lens 226 and the LED module 212. The adhesive layer 284 may be disposed between the lens 226 and the lower perimeter surface 288 of the LED module 212. The lens 226, once attached, may be used to retain the reflector 228 within the LED module 212. Attaching the lens 226 to the LED module 212 using an adhesive allows for rapid installation, lower material cost, and clean finished appearance. It also accommodates the design of the LED module 212 as a threaded unit that can be installed in and removed from a permanently installed lamp housing 202 using a spanner-type extraction tool 225. Adhesive lens mounting also prevents unsightly light leakage from around the lens 226.

The lens 226 may be frosted to increase the amount of light reflected back from the upper lens surface 287 rather than transmitted or refracted through the lens 226. The first, second, and third annular reflective surfaces 234, 248, 264 of the reflector 228 help re-transmit that light back through the lens and reduce any "dark" areas that might otherwise be left.

The lens 226 may comprise an opaque, radially outer circumferential lens mask 286 shaped to conceal a forward perimeter surface 288 of the LED module 212 and to limit or preclude the appearance of a dark ring on the lens as viewed from below. As shown in FIGS. 18 and 19, the mask 286 may comprise a layer of silk-screened silver paint applied to an upper surface 287 of the lens 226 in an annular band that may extend radially inward far enough to conceal the forward perimeter surface 288 of the LED module 212 and a lower edge 290 of the reflector 228. In other embodiments the lens mask 286 may comprise any suitable color of paint applied by any suitable means, and may comprise any suitable substance other than paint.

The reflective surfaces 234, 248, and/or 264 and lens 226 of an interior illumination assembly constructed as described above will provide a multitude of reflections and refractions that will together form a single smooth beam from a source LED. The outer circumferential lens mask will conceal interior structures and limit or preclude formation of a dark outer ring.

This description, rather than describing limitations of an invention, only illustrates embodiments of the invention that's recited in the claims. The language of this description is therefore exclusively descriptive and is non-limiting.

Obviously, it's possible to modify this invention from what the description teaches. Within the scope of the claims, one may practice the invention other than as described above.

What is claimed is:

1. An assembly for illuminating the interior of a compartment, the assembly comprising:

a lamp housing having an opening at one end and configured to be mounted on an interior panel in a position to direct light from the housing opening into the compartment through a hole in the panel;

a lamp removably supportable within the lamp housing in a position to emit light from the housing through the housing opening when the lamp is energized, the lamp including;

an LED module having a module opening at one end and carrying a light-emitting diode (LED), the LED module being removably receivable by the lamp housing into an installed position in which light emitted by the LED is directed through the module opening and the housing opening:

a lens disposed across the module opening;

a reflector carried by the LED module and configured and disposed in a position to reflect light from the LED such that the light passes through the housing and module openings and the lens into the compartment when the LED module is in its installed position in the lamp housing; and the reflector comprising two or more annular reflective surfaces configured and positioned to provide a uniform light distribution across the lens.

2. An illumination assembly as defined in claim 1 in which a first annular reflective surface of the two or more annular reflective surfaces has a generally frustoconical shape angled to reflect light in desired directions.

3. An illumination assembly as defined in claim 2 in which a second annular reflective surface of the two or more annular reflective surfaces is configured and positioned to reflect back toward the lens, LED light that has reflected off the lens.

4. An illumination assembly as defined in claim 3 in which the second annular reflective surface is disposed concentrically with the first reflective surface.

5. An illumination assembly as defined in claim 3 in which the second annular reflective surface of the reflector has a parabolic profile.

6. An illumination assembly as defined in claim 5 in which an inner circumference of the second annular reflective surface is spaced axially upward from an outer circumference of the second annular reflective surface.

7. An illumination assembly as defined in claim 5 in which an inner circumference of the second annular reflective surface is greater than or equal to an outer circumference of the first annular reflective surface.

8. An illumination assembly as defined in claim 7 in which:

the inner circumference of the second annular reflective surface is greater than the outer circumference of the first annular reflective surface; and the reflector includes a third annular reflective surface disposed between the inner and outer annular reflective surfaces.

9. An illumination assembly as defined in claim 8 in which the third annular reflective surface has a flat profile oriented generally normal to a cone axis of the first annular reflective surface and configured to reflect back toward the lens LED light that has reflected off the lens.

10. An illumination assembly as defined in claim 1 in which the reflector has a surface that engages the LED.

11. An illumination assembly as defined in claim 1, in which the reflector has a top aperture disposed axially opposite a base opening, the top aperture being disposed coaxially adjacent the LED and the base opening being disposed coaxially adjacent the module opening.

12. An illumination assembly as defined in claim 1, in which the LED module includes a metal heat sink that carries the LED such that the LED is in thermally conductive communication with the heat sink, the LED module being sized to pass from a position above the housing opening completely through the housing opening and the hole in the ceiling panel so that the LED module can be removed from the assembly without removing the lamp housing from a mounted position on the ceiling panel.

13. An illumination assembly as defined in claim 1 in which threads are formed in an inner cylindrical wall of the lamp housing to receive threads formed in an outer circumferential surface of the LED module in threaded engagement.

14. An illumination assembly as defined in claim 13 in which the LED module includes at least two prong receptacles positioned to be engaged by respective prongs of a spanner wrench configured to apply torque to and rotate the LED module relative to the lamp housing.

15. An illumination assembly as defined in claim 1 in which the lens is fixed to the LED module by an adhesive layer disposed between the lens and the LED module.

16. An illumination assembly as defined in claim 15 in which:

the LED module includes a forward perimeter surface disposed adjacent a front module rim defining the module opening;

the lens is fixed to the forward perimeter surface; and the adhesive layer is disposed between the lens and the forward perimeter surface of the LED module.

17. An illumination assembly as defined in claim 16 in which the adhesive layer comprises a high temperature silicone.

18. An illumination assembly as defined in claim 16 in which the reflector is retained within the LED module by the lens.

19. An illumination assembly as defined in claim 1 in which:

the LED module includes a forward perimeter surface disposed adjacent a front module rim defining the module opening;

the lens is disposed on the forward perimeter surface; and the lens comprises an opaque outer mask shaped to conceal the forward perimeter surface of the LED module.

20. An illumination assembly as defined in claim 19 in which the mask is shaped to conceal a reflector lower edge that defines a base opening of the reflector.

21. An illumination assembly as defined in claim 19 in which the opaque outer mask comprises a layer of paint.

22. An illumination assembly as defined in claim 21 in which the opaque outer mask comprises silk-screened paint.

23. An illumination assembly as defined in claim 1, in which the LED module includes a metal heat sink that carries the LED such that the LED is in thermally conductive communication with the heat sink, the LED module being sized to pass from a position above the housing opening completely through the housing opening and the hole in the ceiling panel so that the LED module can be removed from the assembly without removing the lamp housing from a mounted position on the ceiling panel, the housing including threads formed in an inner cylindrical wall of the lamp housing to receive threads formed in an outer circumferential surface of the LED module in threaded engagement.

24. An assembly for illuminating the interior of a compartment, the assembly comprising:

a lamp housing having an opening at one end and configured to be mounted on an interior panel in a position to direct light from the housing opening into the compartment through a hole in the panel;

a lamp removably supportable within the lamp housing in a position to emit light from the housing through the housing opening when the lamp is energized, the lamp including;

an LED module having a module opening at one end and carrying a light-emitting diode (LED), the LED module being removably receivable by the lamp housing into an installed position in which light emitted by the LED is directed through the module opening and the housing opening:

a lens disposed across the module opening;

a reflector carried by the LED module and configured and disposed in a position to reflect light from the LED such that the light passes through the housing and module openings and the lens into the compartment when the LED module is in its installed position in the lamp housing;

the reflector including a first generally annular reflective surface having a generally frustoconical shape angled to reflect light in desired directions; and the first annular reflective surface having a linear profile angled outward from an imaginary apex of the frustoconically shaped surface at an angle of about 42 degrees to a cone axis of the first annular reflective surface.

25. An assembly for illuminating the interior of a compartment, the assembly comprising:

a lamp housing having an opening at one end and configured to be mounted on an interior panel in a position to direct light from the housing opening into the compartment through a hole in the panel;

a lamp removably supportable within the lamp housing in a position to emit light from the housing through the housing opening when the lamp is energized, the lamp including;

an LED module having a module opening at one end and carrying a light-emitting diode (LED), the LED module being removably receivable by the lamp housing into an installed position in which light emitted by the LED is directed through the module opening and the housing opening:

a lens disposed across the module opening; and a reflector carried by the LED module and configured and disposed in a position to reflect light from the LED such that the light passes through the housing and module openings and the lens into the compartment when the LED module is in its installed position in the lamp housing, the reflector including at least one detent that engages a corresponding detent in the LED module.

26. An assembly for illuminating the interior of a compartment, the assembly comprising:

a lamp housing having an opening at one end and configured to be mounted on an interior panel in a position to direct light from the housing opening into the compartment through a hole in the panel;

a lamp removably supportable within the lamp housing in a position to emit light from the housing through the housing opening when the lamp is energized, the lamp including;

an LED module having a module opening at one end and carrying a light-emitting diode (LED), the LED module being removably receivable by the lamp housing into an installed position in which light emitted by the LED is directed through the module opening and the housing opening:

a lens disposed across the module opening;

a reflector carried by the LED module and configured and disposed in a position to reflect light from the LED such that the light passes through the housing and module openings and the lens into the compartment when the LED module is in its installed position in the lamp housing;

threads formed in an inner cylindrical wall of the lamp housing to receive threads formed in an outer circumferential surface of the LED module in threaded engagement;

the LED module including at least two prong receptacles positioned to be engaged by respective prongs of a spanner wrench configured to apply torque to and rotate the LED module relative to the lamp housing; and including lens apertures axially alignable with the prong receptacles of the LED module and configured to allow prongs of a spanner wrench to extend through the lens apertures of the lens and engage the prong receptacles of the LED module.

27. An illumination assembly as defined in claim 26 in which the two prong receptacles are disposed in diametrically opposite positions on the LED module relative to a rotational axis of the LED module.

* * * * *